US006267499B1

(12) United States Patent
Damasko

(10) Patent No.: US 6,267,499 B1
(45) Date of Patent: Jul. 31, 2001

(54) CASE FOR A WRISTWATCH

(76) Inventor: Konrad Damasko, Unterheising 2, D-93092 Barbing (DE)

( * ) Notice: Subject to any disclaimer, the term of this patent is extended or adjusted under 35 U.S.C. 154(b) by 0 days.

(21) Appl. No.: 09/510,306

(22) Filed: Feb. 22, 2000

(30) Foreign Application Priority Data

Feb. 23, 1999 (DE) ..... 299 03 203 U

(51) Int. Cl.[7] ..... G04B 37/00

(52) U.S. Cl. ..... 368/280

(58) Field of Search ..... 368/88, 276, 280, 368/281

(56) References Cited

U.S. PATENT DOCUMENTS 4,433,921 * 2/1984 Gogniat ..... 368/294
4,561,783 * 12/1985 Lederrey ..... 368/309

FOREIGN PATENT DOCUMENTS 693 146 7/1940 (DE) .
44 07 170 A1 9/1995 (DE) .
195 19 714 A1 11/1996 (DE) .

* cited by examiner

*Primary Examiner*—Vit Miska
(74) *Attorney, Agent, or Firm*—Hoffman, Wasson & Gitler

(57) ABSTRACT

A wrist watch case consisting of a case element housing the clockwork with a crystal closing the case on the top and with a cover closing the case on the bottom.

11 Claims, 1 Drawing Sheet

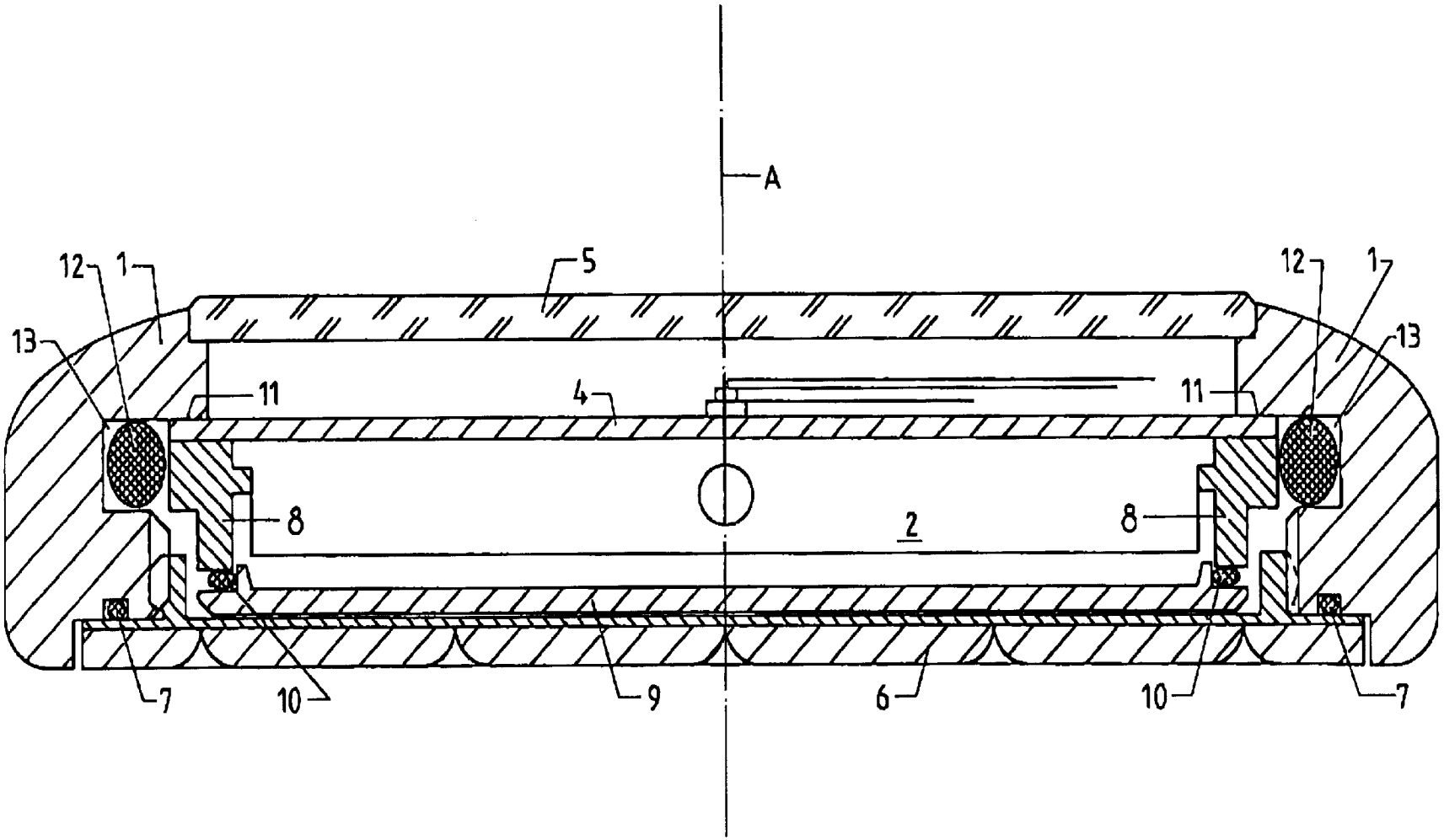
1
12
13
11
8
10
7
2
6
A
5
4
9
8
11
10
1
12
13
7

CASE FOR A WRISTWATCH

SUMMARY

The invention pertains to a new type of construction for wrist watch cases, consisting of a case element housing the clockwork with a crystal closing the case on the top and with a cover closing the case on the bottom

BRIEF DESCRIPTION OF DRAWING

The FIGURE of drawing shows a wrist watch case according to the invention

| List of reference symbols | |
|---|---|
| 1 | case |
| 2 | clockwork |
| 3 | hands |
| 4 | face |
| 5 | crystal |
| 6 | outer case cover |
| 7 | sealing ring |
| 8 | intermediate ring |
| 9 | intermediate cover |
| 10 | sealing ring |
| 11 | flange |
| 12 | damper ring |
| 13 | groove |

CASE FOR WRIST WATCHES

The invention pertains to a case for wrist watches.

Cases for wrist watches are known in a wide variety of embodiments.

It is also known that highly tempered corrosion-resistant objects such as knives, scissors, surgical instruments, tools etc. can be manufactured inexpensively on conventional machines and by hardening afterwards using steel with the following composition:

| | | | |
|---|---|---|---|
| carbon: | 0,6–2% | molybdenum | 0.2–2% |
| chromium: | 16–25% | vanadium: | 0.2–3% |
| tungsten: | 1–7% | iron: | traces. |

The object of the invention is to present a case that possesses a high degree of functionality and, at the same time, a high degree of stability.

In order to solve this problem, a case in accordance with the characteristics of patent claim 1 is exemplified.

In the case according to the present invention, at least the case element, but preferably also the outer cover that closes the case on the bottom is made of a hardenable stainless steel of the type X30CrMoN 15-1, which has a carbon content and nitrogen content greater than 0.6%, e.g. between 0.55–0.75%.

Although the aforementioned steel can be processed in an unhardened state by conventional means and on conventional machines in a relatively simple and inexpensive manner, and after tempering a very robust, hard watch case is obtained, these materials have heretofore been regarded by experts as unsuitable for the manufacture of clock cases and especially for wrist watches, due to the fact that such steels are highly magnetizable, especially by external magnetic fields, so that they function as permanent magnets whose magnetic field strongly impairs the highly sensitive clockwork of a wrist watch. Other technologies have thus been used heretofore to obtain highly hardened watch cases; these cases are manufactured from ceramics, which is, however, an expensive and complicated process.

The invention is based on the realization that the aforementioned hardenable steel surprisingly is suitable for wrist watch cases, and especially if in the interior of the case a ring or plate enclosing the clockwork is made of a diamagnetic metal. It has been shown that by means of this ring or plate the part of the case interior that houses the clockwork can be kept free from a magnetic field that would impair the functioning and accuracy of the clockwork. Additional embodiments of the invention are the subject of the dependent claims.

In the following, the invention is described in more detail by means of an example embodiment with reference to the FIGURE. The FIGURE shows a cross-section in simplified depiction of a case according to the invention for a men's and/or ladies' wrist watch, together with a clockwork located in this case.

In the FIGURE, 1 is the outer case of a men's and ladies' wrist watch, in which the clockwork 2 with the hands 3 and the face 4 is housed and which is closed tightly on the top, shown at the top of the FIGURE, by a crystal 5 of sapphire glass and on the bottom by a cover 6. The axis of the clockwork 2, around which the hands 3 revolve, is designated by A. The crystal 5 is embedded in a suitable manner in a groove on the top of the case and fastened there tightly, for example by gluing or some other suitable means. The cover 6 is fastened to the bottom of the case 1 by screwing, and sealed by a sealing or O-ring 7

In the interior of the case 1, a ring 8 is provided for that encircles the clockwork 2 and which houses the clockwork 2. The ring 8 has an axial height that is equal or similar to the height of the clockwork 2. Additionally, in the interior of the case 1 an intermediate cover 9 is provided for that closes the ring 8 on the side facing the outer cover 6 and, by means of a second sealing ring 10, tightly seals the auxiliary case formed by the ring 8 below, i.e. on the side facing the cover 6. The surfaces of the intermediate cover 9 are located parallel to the surfaces of the outer cover 6 and parallel to the surfaces of the face 4 and the crystal 5 and thus also in planes perpendicular to the axis A of the watch, which is determined by the axis of the hands 3. The intermediate cover 9 is held on the ring 8 by the fact that this intermediate cover is pressed on the side opposite of the clockwork 2 against the inner surface of the outer cover 6, under elastic deformation of the sealing ring 10, so that a positioning of the intermediate cover 9 without rattling or clattering is ensured.

The ring 8 is supported on the side depicted above in the FIGURE on the circumference of the face 4, which itself is pressed against a flange 11 that is formed on the inner surface of the case 1 in such a way that the diameter of the interior of the case 1 decreases toward the top of the case to form a circular bearing surface (flange 11) in a plane perpendicular to the axis A. 12 designates a ring made of an elastic material such as elastic plastic or rubber, that encompasses the ring 8 on the end adjacent to the face 4 as well as the axis A and is positioned in an open groove 13 of the case toward the interior of the case. The damper ring 12 forms an elastic bedding of the ring 8 and thus of the clockwork 2 and protects this clockwork from external shocks affecting the watch.

The characteristic feature of the depicted watch consists in the fact that the case 1 as well as the outer cover 6 are manufactured from a solid material by machining on a metal lathe, preferably on a CNC lathe, from a corrosion-resistant and acid-proof steel that is hardenable and has a carbon and nitrogen content greater than 0.1%.

For the manufacture of the case 1 and the outer cover 6 a steel especially of the group X3CrMoN15-1 (1.4108/AMS 5898-X30 CrMoN15-1) is used, whereby this steel contains carbon, silicon, manganese, phosphorus, sulfur, chromium, molybdenum, nickel, aluminum, nitrogen, titanium and copper in the following amounts and the total carbon and nitrogen content is approximately 0.6–0.7:

| X30CrMoN 15-1: | |
|---|---|
| carbon (C): | 0.31% |
| nitrogen (N) | 0.40% |
| silicon (Si): | 0.5% |
| manganese (Mn): | 0.53% |
| phosphorus (P): | 0.014% |
| sulfur (S): | 0.007% |
| chromium (Cr): | 14.69% |
| molybdenum (Mo): | 1.05% |
| nickel (Ni): | 0.19% |
| aluminum (Al): | 0.005% |
| vanadium (V): | 0.05% |
| titanium (Ti): | 0.003% |
| copper (Cu): | 0.05% |

In particular, the manufacture of the case 1 as well as the cover 6 from the solid material takes place by means of machining, in which a blank is first produced. Afterwards this blank is heated in a vacuum furnace or in a protective furnace atmosphere to a temperature above 1000° C., preferably to a temperature between 1030 and 1060° C. and then quenched. This is followed by stress relief of the hardened blank at a temperature below 200° C., i.e. at a temperature between approx. 170~180° C. for a period of one to two hours.

The case 1 and the cover 6, which then have a hardness of up to 63 or 65 HRC, can be post-processed on the surfaces, for example by abrasive blasting with glass beads, mirror-bright polishing, or CVD-PVD coating.

With the process described above a high-quality and extremely durable case 1 with a cover 6 of the same high quality and durability can be achieved. In order to be able to use the aforementioned material, however, at least for a mechanical clockwork the intermediate ring 8 is necessary, which is made of one of the magnetic metal materials, i.e. of a material that deflects existing magnetic lines. Suitable materials are especially copper alloys and specifically copper-tin or copper-zinc alloys. The ring 8 is preferably made of CuZn 40 A12.

The face 4 or the disc forming this face and the intermediate cover 9 are made of the same material as the ring 8, so that the clockwork 2 is housed completely in a case or in a shield made of the magnetic metal material. Instead of the face 4 and/or the intermediate cover 9, it can also suffice to have flat, disc-shaped rings that only partially close the upper and/or lower open sides of the ring 8.

With the embodiment described above it is possible to use the above-mentioned steel, which is easy-to-process and, after hardening, has an extremely high degree of hardness, for the case 1 and the outer cover 6, and yet guarantee a high degree of accuracy for the sensitive clockwork 2.

What is claimed is:

1. Case for wrist watches, consisting of a case element (1) housing the clockwork with a crystal (5) closing the case on the top and with a cover (6) closing the case on the bottom, characterized in that at least the case element (1) is made of a hardenable stainless steel of the type X30 CrMo N15-1.

2. Cases according to claim 1, characterized in that the hardenable steel possesses the following alloy percentages:

| | |
|---|---|
| carbon (C): | 0,31% |
| nitrogen (N): | 0.40% |
| silicon (Si) | 0.5% |
| manganese (Mn): | 0.53% |
| phosphorous (P): | 0.014% |
| sulfur (S): | 0.007% |
| chromium (C): | 14.69% |
| molybdenum (Mo): | 1.05% |
| nickel (Ni): | 0.19% |
| aluminum (Al): | 0.005% |
| vanadium (V): | 0.05% |
| titanium (Ti): | 0.003% |
| copper (Cu): | 0.05% |

3. Case according to claim 1 or 2, characterized in that an intermediate ring (8) encasing the clockwork (2) is provided for in the outer case element (1).

4. Case according to claim 1, characterized in that the outer cover (6) is likewise made of the hardenable stainless steel.

5. Case according to claim 1, characterized in that at least part of a face (4) is made of the diamagnetic metal material.

6. Case according to claim 1, characterized in that a cover (9) or ring made of the diamagnetic metal material is provided for on the side of an intermediate ring (8) facing the bottom of the case.

7. Case according to claim 1, characterized in that the diamagnetic metal material is a copper alloy, preferably a copper-tin or copper-zinc alloy.

8. Case according to claim 7, characterized in that the diamagnetic material is CuZn 40 A12.

9. Case according to claim 1, characterized in that the case element (1) and/or the cover (6) are heated in a protective furnace atmosphere to a temperature above 1000° C., preferably to a temperature between 1030 and 1060° C.

10. Case according to claim 1, characterized in that the case element (1) and/or the cover (6) after hardening and quenching are treated on the surface by abrasive blasting with glass beads.

11. Case according to claim 1, characterized in that the case element (1) and/or the cover (6) after hardening and quenching are mirror-polished and/or PVD and/or CVD coated.

* * * * *